US005532802A

United States Patent [19]

Sonnenberg et al.

[11] Patent Number: 5,532,802

[45] Date of Patent: Jul. 2, 1996

[54] PIEZOELECTRIC SENSOR FOR IN-SITU MONITORING OF ELECTROSTATOGRAPHIC DEVELOPERS

[75] Inventors: Sven Sonnenberg, Rochester; Donald S. Rimai, Webster; David D. Almeter; Martin Potucek, both of Rochester, all of N.Y.

[73] Assignee: Eastman Kodak Company, Rochester, N.Y.

[21] Appl. No.: 372,639

[22] Filed: Jan. 13, 1995

[51] Int. Cl.[6] ..... G03G 21/00

[52] U.S. Cl. ..... 355/246; 355/200; 355/208

[58] Field of Search ..... 355/200, 203, 355/208, 245, 246

[56] References Cited

U.S. PATENT DOCUMENTS

| | | | |
|---|---|---|---|
| 3,353,098 | 11/1967 | Foster et al. | 325/45 |
| 4,916,488 | 4/1990 | Kimura | 355/208 |
| 5,006,897 | 4/1991 | Rimai et al. | 355/246 |
| 5,055,881 | 10/1991 | Fukuchi | 355/208 X |
| 5,122,842 | 6/1992 | Rimai et al. | 355/326 |
| 5,160,966 | 11/1992 | Shiina et al. | 355/246 X |
| 5,187,522 | 2/1993 | Resch, III | 355/246 |
| 5,214,475 | 5/1993 | Ishii et al. | 355/246 |
| 5,233,260 | 8/1993 | Harada et al. | 310/328 |
| 5,235,388 | 8/1993 | Rimai et al. | 355/246 |
| 5,270,783 | 12/1993 | Bisaiji et al. | 355/246 |
| 5,285,243 | 2/1994 | Rimai et al. | 355/246 |
| 5,438,393 | 8/1995 | Komatsu et al. | 355/246 |

*Primary Examiner*—Sandra L. Brase
*Attorney, Agent, or Firm*—Milton S. Sales

[57] ABSTRACT

A toner mass sensor includes a piezoelectric crystal having a resonant frequency, an electrode on a first face of the crystal, an electrically conductive lead connecting the first face of the crystal to an electrical contact point in the vicinity of a second side of the crystal, and a casing closed at one end by the crystal with the first face of the crystal allowed to contact developer outside of the closed casing through the opening of the casing. The casing and crystal defines an interior which is sealed from developer in a development station, within which sealed interior the second face of the crystal is protected from contamination by developer. The electrode is wrapped around the edge of the crystal to be accessible from the second side of the crystal, and the electrode is a metal; preferably aluminum. The interior of the casing is closed by a base member which carries an electrical circuit. The casing is cylindrical, and an elastomeric, electrical insulator gasket around the crystal seals the interior of the casing to inhibit contamination of the interior of the casing by developer.

22 Claims, 7 Drawing Sheets

PIEZOELECTRIC SENSOR FOR IN-SITU MONITORING OF ELECTROSTATOGRAPHIC DEVELOPERS

BACKGROUND OF THE INVENTION

1. Technical Field

The present invention relates to the field of electrostatographic recording, such as electro-photography and electrography; and more particularly to an improved apparatus for monitoring the rate and amount of toner deposited by a development station.

2. Background Art

Generally, in electrostatographic image-forming machines such as printers and/or copiers, an electrostatic latent image is first formed on a member such as a photoconducting element. The electrostatic latent image is then developed into a visible image by bringing the latent image-bearing photoconductive element to a development station, whereat marking particles are deposited onto the electrostatic latent image. Specifically, in a xerographic process, the marking particles are in a dry format (i.e., they are not dispersed or suspended in a liquid medium).

So-called "two-component" developers consisting of pigmented marking articles and magnetic carrier particles are most commonly used in xerography. During the development process, the marking, or toner, particles, are mixed with the carrier particles and tribocharged against the carrier particles and become electrostatically attached to those carrier particles. The developer is then brought into contact with the latent image-bearing element using a development station, such as that consisting of an electrically biased metallic shell with a core consisting of a series of adjacent magnets. As the shell and/or core of the development station rotates against the electrostatic image-bearing member, the electrically charged toner particles are attracted to the electrostatic latent image and ultimately become attached to the photoconductive element. The carrier particles are electrostatically repelled by the electrostatic latent image and are electrostatically and magnetically attracted to the development station, wherein the resulting charge on the toner-depleted developer is dissipated and is mixed with fresh toner particles and made ready for subsequent imaging. Other types of developers also exist. For example, so-called "third-component developers" contain one or more particulate addenda added for charge stability, cleaning, or other reasons to a two-component developer.

Traditionally, the amount of toner deposited on the photoconductive element has been monitored using techniques such as on-line densitometry whereby the amount of toner in a certain test area of the photoconductive element is monitored. However, this technique cannot differentiate from factors within the development station from other factors which affect the amount of toner deposited in the test region. In addition, such methods only reveal how much toner is present after development, rather than determining the rate at which the toner is being deposited.

Recently, methods of monitoring the rate and amount of toner deposited within a development station have been disclosed in U.S. Pat. Nos. 5,006,897, 5,122,842, 5,235,388, and 5,285,243, the disclosures of which are specifically incorporated herein by reference. According to the techniques disclosed, a piezoelectric transducer is suspended into the xerographic developer. The transducer is first biased to attract the toner and the shift in resonance frequency associated with the mass of toner deposited at a given voltage and/or known bias potential, is determined. Subsequently, the sign of the bias is reversed and the toner particles are removed from the piezoelectric transducer, thereby readying it for the next measurement.

Although the use of a piezoelectric sensor does allow the toner mass deposited as a function of time and/or applied voltage to be determined and promises to be a very useful and powerful tool in xerography, the actual implementation of such a device into commercial equipment has been problematical.

SUMMARY OF THE INVENTION

According to one feature of the present invention, it has been discovered that there has been no adequate method of suspending the piezoelectric element in the developer nap in an actual machine. For example, U.S. Pat. Nos. 5,235,388 and 5,285,243 disclose suspending the piezoelectric crystal by two fine wires which are soldered to the crystal to also supply the electrical bias and oscillation voltage. Although this technique was adequate for laboratory experimentation, it would not be adequate for a practical implementation of this technology. Suspending the crystal from two wires would not give adequate mechanical support so as to eliminate errors due to vibrations in general, and from the buffering of the crystal by the developer in particular. Moreover, the leads could serve as a source or antenna for RF interference. The open structure of this type of support would subject the back of the crystal to particulate contamination from the developer and other sources. This contamination would be difficult to remove and would adversely effect the operation of the device over time. Installation and maintenance of this type of device would be labor intensive and, therefore, expensive. Thus, it is an object of the present invention to make a piezoelectric development sensor practical for commercially available equipment by providing a new type of holder.

According to another feature of the present invention, a holder for a piezoelectric development sensor fits into the development station, yet does not interfere with the development process. The holder firmly supports the piezoelectric crystal, yet does not clamp the crystal. The holder keeps contamination off the back side of the crystal, but allows the front surface to contact the developer. In addition to these physical attributes of the holder, it also allows appropriately high DC toning and cleaning voltages to be applied to the crystal along with the necessary excitation voltages.

According to still another feature of the present invention, a toner mass sensor includes a piezoelectric crystal having a resonant frequency, an electrode on a first face of the crystal, an electrically conductive lead connecting the first face of the crystal to an electrical contact point in the vicinity of a second side of the crystal, and a casing closed at one end by the crystal with the first face of the crystal allowed to contact developer outside of the closed casing through the opening of the casing. The casing and crystal defines an interior which is sealed from developer in a development station, within which sealed interior the second face of the crystal is protected from contamination by developer.

According to a preferred embodiment of the present invention, the electrode is wrapped around the edge of the crystal to be accessible from the second side of the crystal, and the electrode is a metal; preferably aluminum. The interior of the casing is closed by a base member which carries an electrical circuit. The casing is cylindrical, and an elastomeric, electrical insulator gasket around the crystal seals the interior of the casing to inhibit contamination of the interior of the casing by developer.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
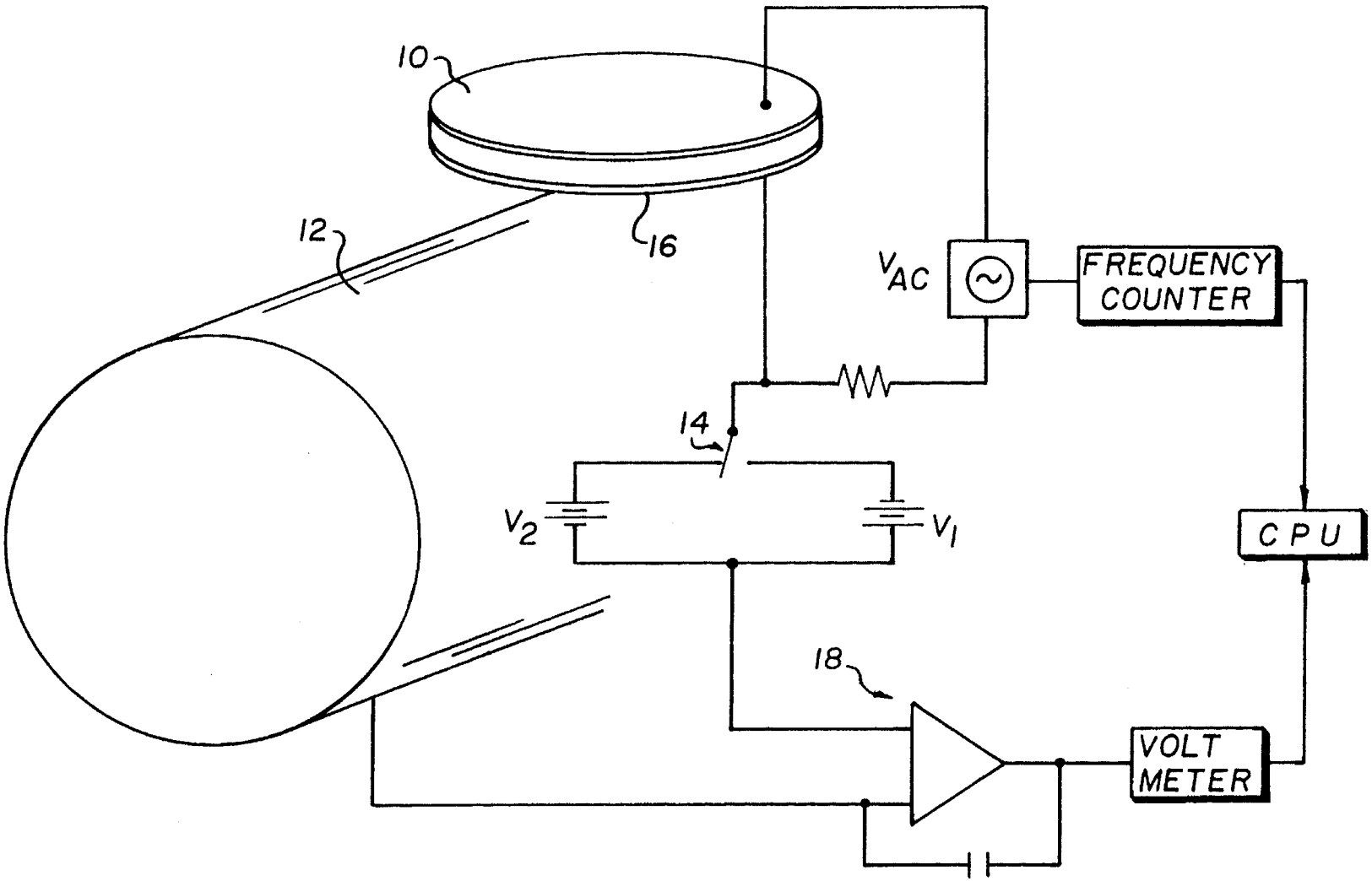
FIG. 1 is a schematic illustration of a toner mass sensor and associated circuitry according to one use of the present invention.

FIG. 1 shows a schematic of a toner mass sensor and associated circuitry according to one use of the present invention. A piezoelectric crystal 10 is positioned in close proximity to a toning roller 12 in a manner approximating the contact of an actual photoconductor with the developer on toning roller 12. Typical crystal-to-roller spacings of approximately 500 μm have been successfully tested.

An AC excitation bias, with a frequency corresponding to the resonant frequency of the crystal, is applied across the crystal beginning at a selected time, $t_0$, while the toning station is run. At time $t_0$, a switch 14 is moved to apply a DC bias, $V_1$, to an electrode 16 on one face of crystal 10 in order to attract the toner particles to the crystal. The current between development roller 12 and crystal electrode, generated by the passage of charged toner particles from development roller 12 to crystal 10, is integrated at 18 until an arbitrarily chosen potential across the integrator is reached; and the time, $t_1$, needed to reach this potential is determined. In tests, the integrator was operated between ±15 volts and time $t_1$ was chosen to occur when the voltage equaled zero. These measurements provided the total charge q of the toner deposited on the electrode of the piezoelectric crystal during the time interval $t_1-t_0$.

Simultaneous with the toning current measurement, the shift ω in the resonant frequency of crystal 10 is determined. This shift is related to the mass, m, of the deposited toner by the equation:

$$\omega^2=K/(m+M)$$

where M is the mass of the transducer and K is a constant determined by the elastic moduli of the material. A simplistic linear development rate, R, is defined here as:

$$R=m/(t_1-t_0).$$

Moreover, the charge-to-mass ratio of the toner, measured in situ, is just $$q/m=CV/m$$

where C is the capacitance across the integrator and V is the change in voltage.

After making the described measurements, the polarity of the DC voltage on crystal electrode 16 is reversed by switch 14, thereby allowing development roller 12 to remove the deposited toner and prepare the transducer for the next measurement.

Figure 2A:
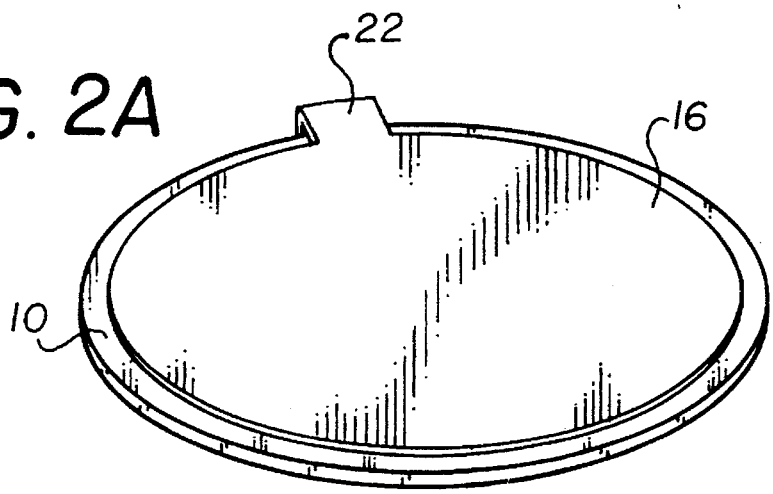
FIGS. 2A, 2B, and 2C are top perspective, side elevational, and bottom perspective views, respectively, of a metallized crystal according to a preferred embodiment of the present invention.
Figure 2B:
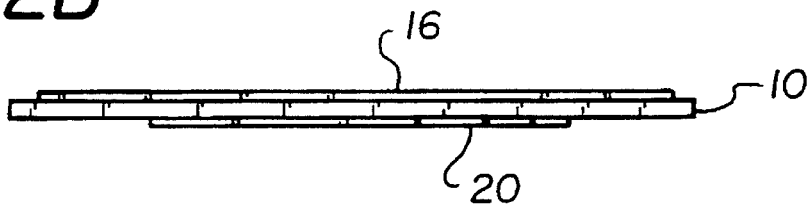
Figure 2C:
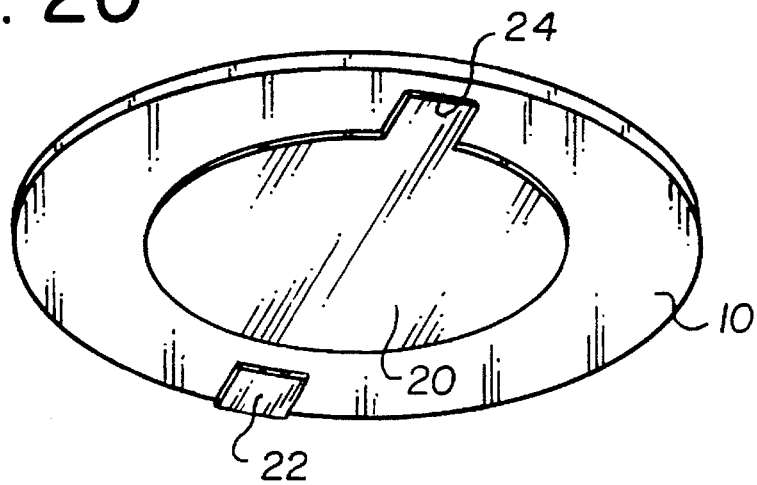

FIGS. 2A, 2B, and 2C show the top, edge, and bottom view of piezoelectric crystal 12. For the purpose of this invention any piezoelectric transducer would suffice. For example, any of the shear, longitudinal, or mixed mode cuts of quartz, lithium niobate, etc. crystals would serve. In addition, the fundamental frequency of oscillation of these crystals can vary over a wide range of values, from kilohertz or lower frequency to tens of megahertz. For reasons which include physical size and sensitivity, stability, and cost, X-cut quartz transducers with a nominal 1 MHz fundamental frequency are preferred.

Conductive electrodes 16 and 20 have been provided, such as by coating on the opposed faces of crystal 10. The conductive electrode pattern on the crystal can be made from any metal. Typically, metals such as chromium, gold, and aluminum are used. For economic reasons aluminum electrodes are preferred. The patterns can be formed by evaporation or other means of deposition (e.g., sputtering) followed by masking and abrading or dissolving electrode material from undesired regions, masking the crystal according to the appropriate design followed by the metallic deposition, etc.

Electrodes 16 and 20 are formed with extensions 22 and 24, respectively. These extensions allow for electrical connection to the associated circuitry of FIG. 1, as will be fully explained below. Note that extension 22 is fully wrapped around the edge of crystal 10 so that the ends of both extensions are located on the same side of the crystal, as best seen in FIGS. 2C.

Figure 3:
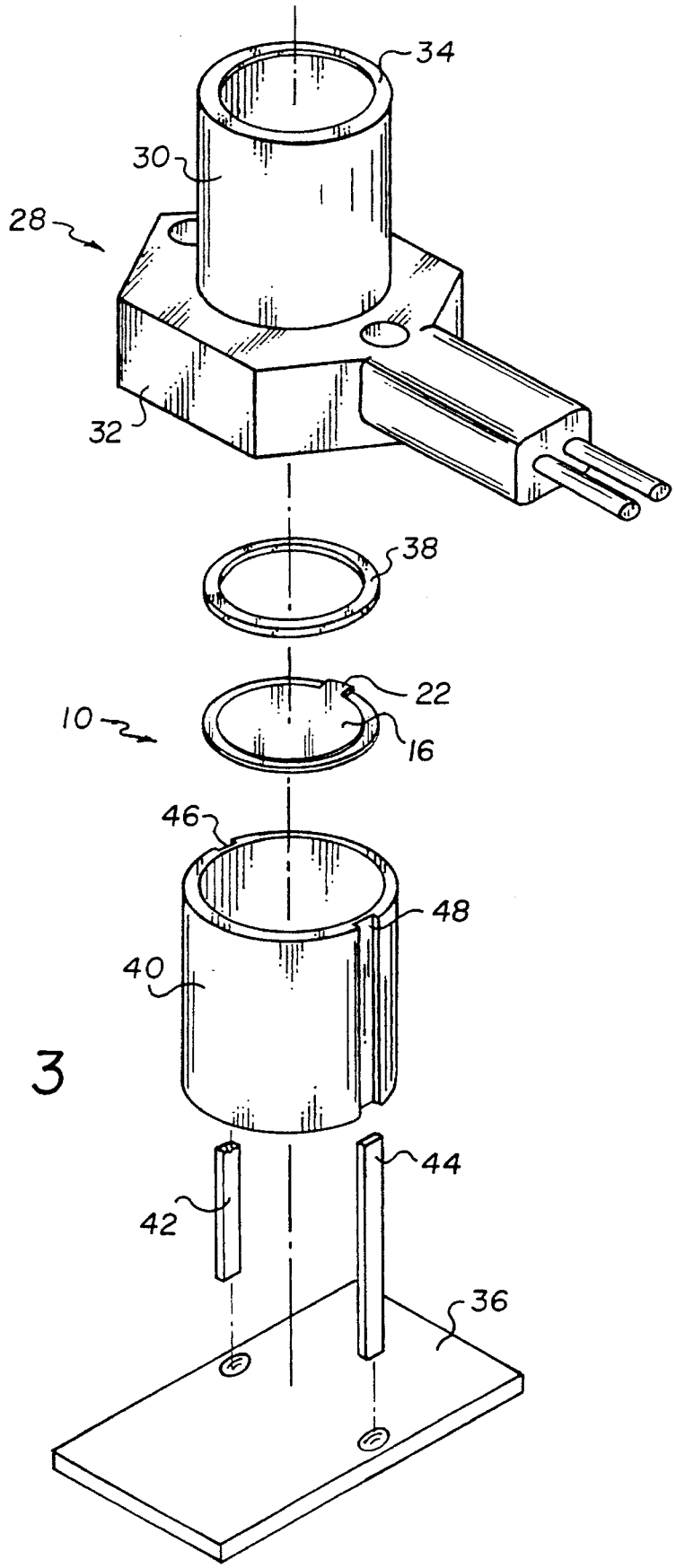
FIG. 3 is an exploded perspective view of a toner mass sensor assembly according to the preferred embodiment of the present invention.
Figure 4:
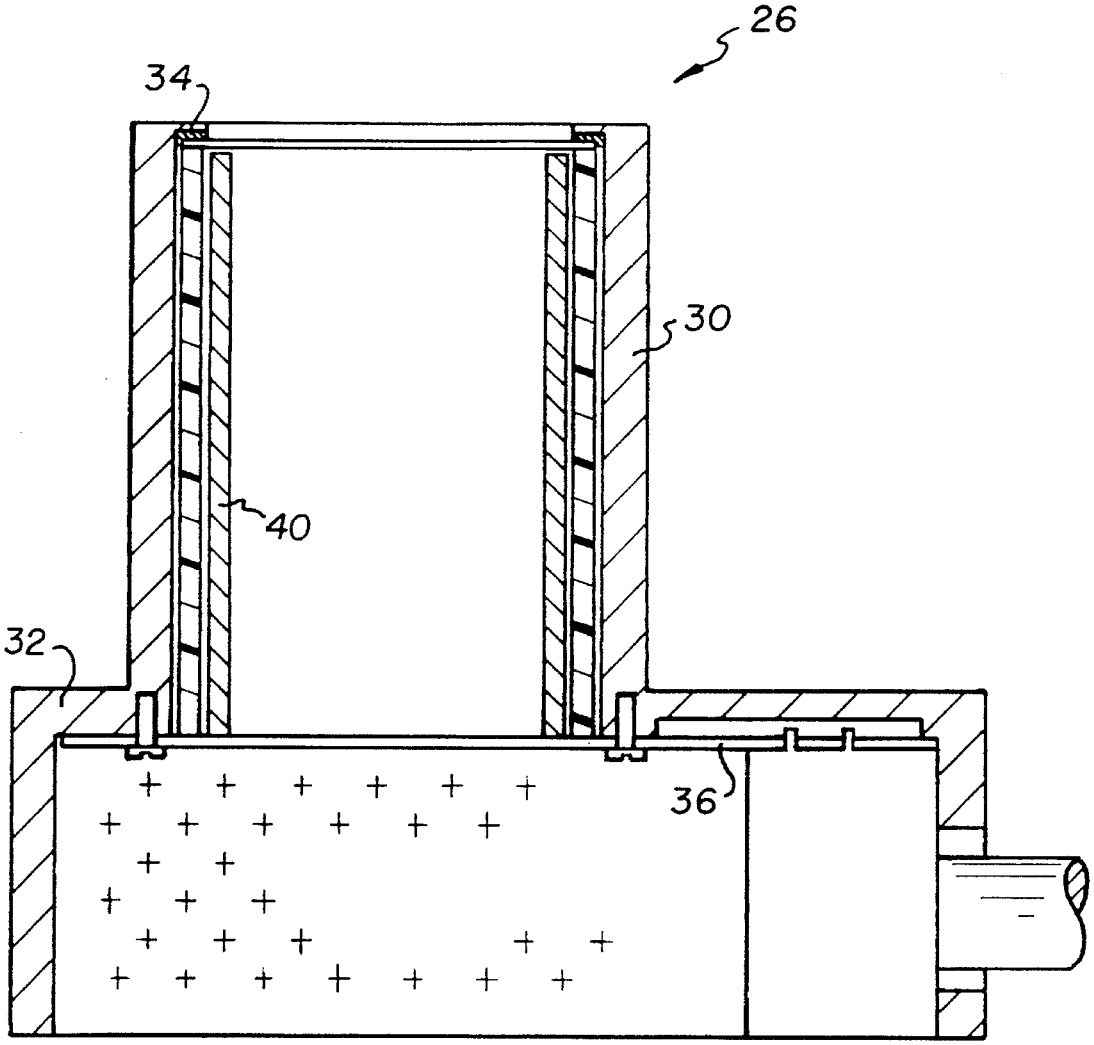
FIG. 4 is an elevational side view partially in section showing the assembly of FIG. 3.
Figure 5:
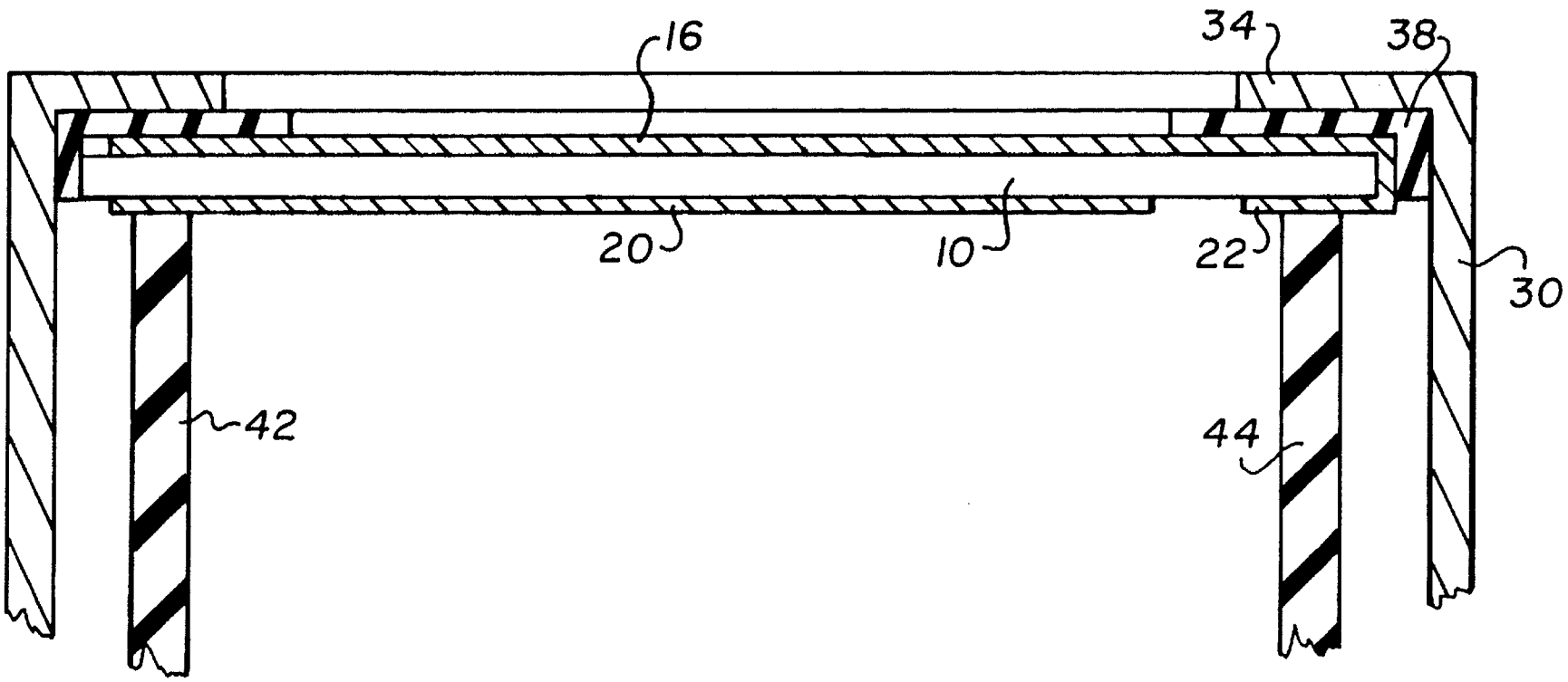
FIG. 5 is a view of a portion of the assembly of FIG. 4 illustrated in greater detail.

Referring to FIGS. 3, 4, and 5, the piezoelectric crystal 10 is mounted in a toner mass sensor assembly 26. The sensor assembly includes a holder 28 having a cylindrical casing 30 integrally formed on a base 32. Casing 30 has an inwardly-extending, annular lip 34. Base 32 has a cavity to receive a circuit board 36 and associated wiring and electronics.

Piezoelectric crystal 10 is positioned in casing 30 against a grooved gasket 38, which in turn is positioned against lip 34 of the casing. The crystal is oriented so that the top (in the illustrated orientation of FIGS. 3–5) surface of the crystal is allowed to contact the developer through the top opening of the casing. The gasket, which is preferably formed of an elastomeric material, effectively seals the interior of holder 28 to preventing toner particulate contamination in the interior of the holder. The gasket also electrically insulates crystal 10 from the holder.

Gasket 38 and crystal 10 are secured in place at the top of casing 30 against lip 34 by a small diameter tube 40, which is inserted into the casing before circuit board 36 is attached, such as by screws as illustrated.

The electrical contact between circuit board 36 and the piezoelectric crystal 10 can be accomplished in a variety of ways. However, FIGS. 3, 4, and 5 show a preferred way using a pair of elastomeric conductors 42 and 44, which respectively fit into a pair of grooves 46 and 48 in the outer surface of tube 40. The conductors contain fine wires (not shown) which electrically connect electrode extensions 22 and 24 with appropriate connectors of circuit board 36. Note that by wrapping extension 22 around the edge of crystal 10, electrical contact with both electrodes can be made within the sealed interior of toner mass sensor assembly 26. Contact can be established by pressure as with the use of elastomer or by the use of small amounts of conductive paint, epoxy or solder.

Figure 6:
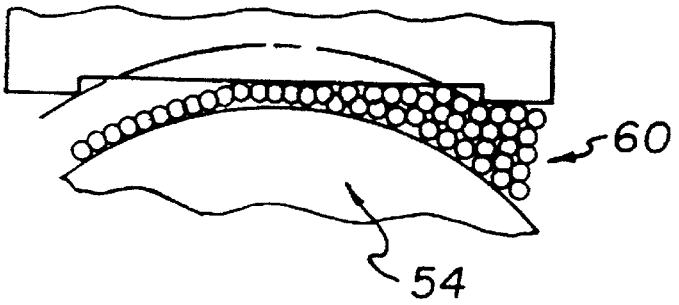
FIG. 6 is an elevational side view showing the preferred crystal holder mounted near the toner roller illustrating the skiving effect of the elevated lip on the toning particles.
Figure 7:
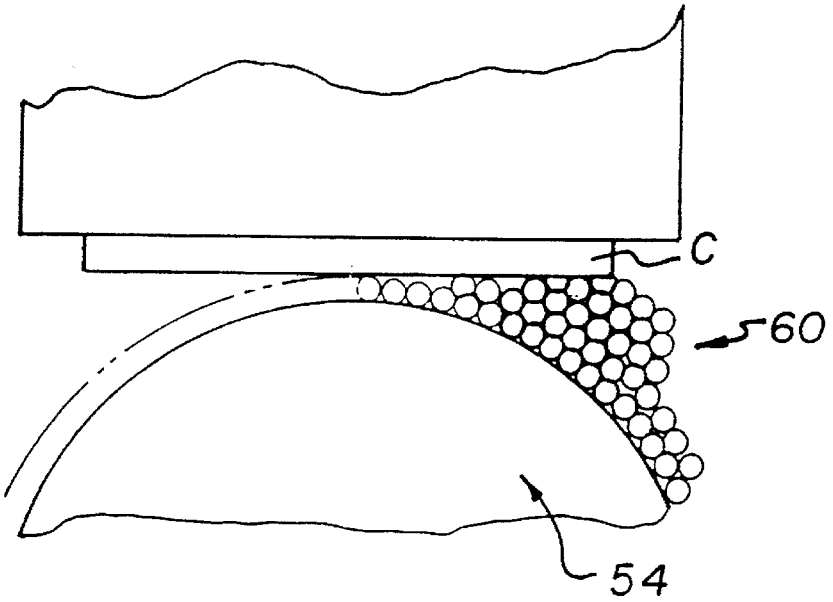
FIG. 7 (PRIOR ART)
FIG. 7 is an elevational side view showing a crystal holder without the novel lip structure and the more turbid toner follow that results.

Lip 34 around the front surface of crystal 10 smoothes out the flow of developer as it moves past the crystal. In a particular reduction to practice, the lip was approximately 0.25 mm thick and acted as a barrier to the waves of developer, performing a skiving action, as shown in FIG. 6. Accordingly, the lip reduces any turbulent flow which could result when there is a build-up of toner, such as illustrated in prior art FIG. 7. As seen in FIG. 7, waves of developer would tend to form around the piezoelectric crystal in the absence of a lip. These waves, which can become sizable, would buffet the piezoelectric crystal. It is believed that lip 34 provides a relatively quiescent region in the vicinity of piezoelectric crystal 10.

Figure 8:
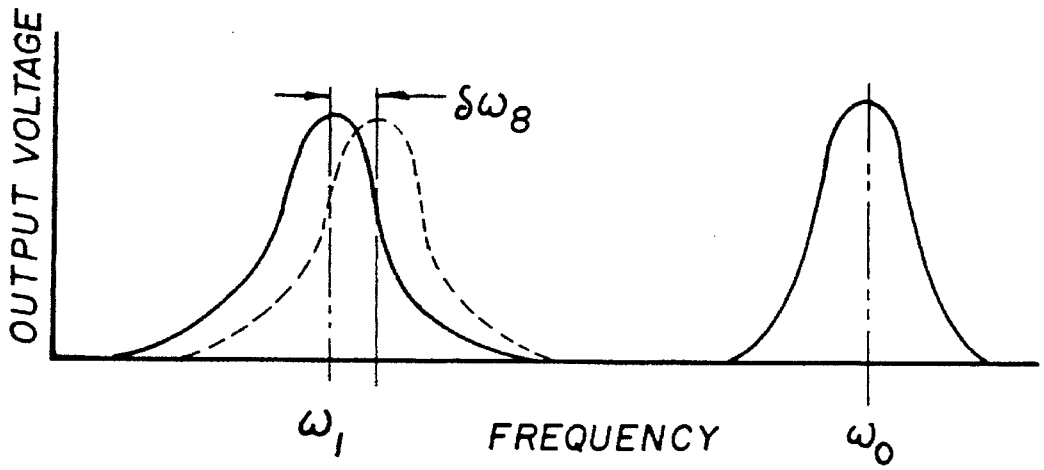
FIG. 8 is a graphical illustration showing how the holder of FIG. 6 results in a more precise determination of the resonant frequency $\omega_1$ with variations in amplitude only.
Figure 9:
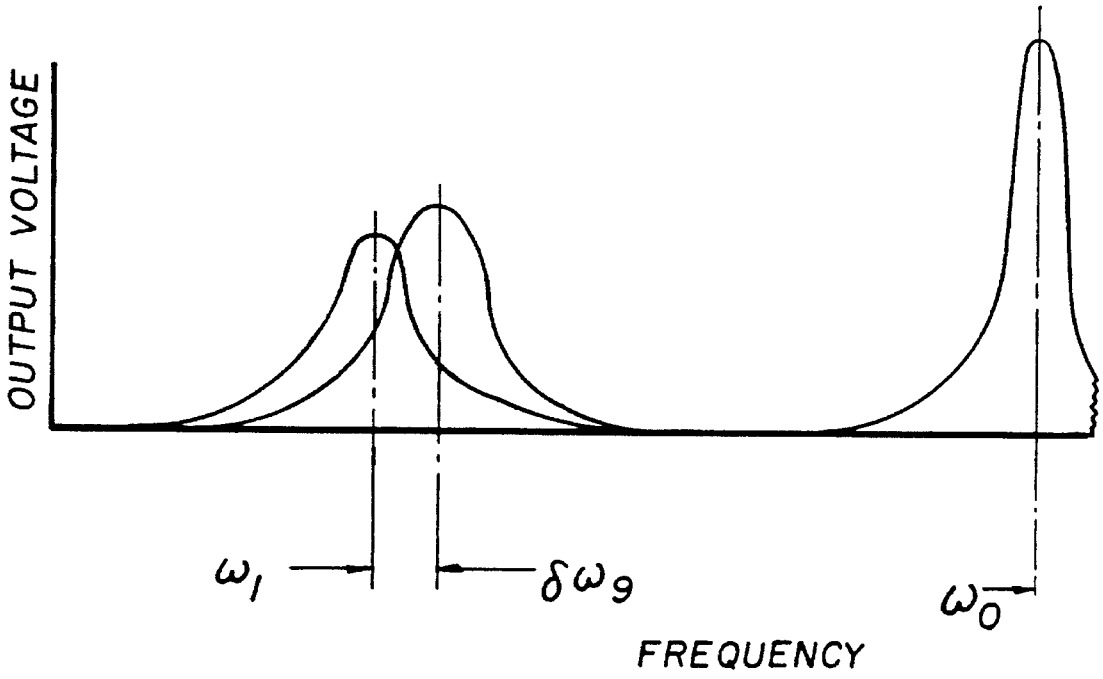
FIG. 9 is a graphical illustration showing how the holder of FIG. 7 results in a less stable resonant frequency $\omega_1$ with variation in both amplitude and frequency.

FIGS. 8 and 9 illustrate the effect on the system of having lip 34 and not having a lip, respectively. The noisy response to the deposited toner within the period of the measurement, is shown in the FIG. 9 plot of resonant frequency. In addition, there is a significant attenuation of the signal as shown in the graph. The resonant frequency readings $\omega_1$ will tend to vary by $\delta\omega$ because of the disturbance in the flow as shown in FIG. 9. The shift in the resonance frequency with toner for a 1 MHz crystal is about 2 KHz. The difference $\omega_0-\omega_1$ is in the order of a couple of KHz, whereas $\delta\omega$ is of the order of a couple of hundred hertz. In the presence of lip 34, $\delta\omega$ is reduced without impeding the flow of the developer, as shown in FIG. 6. This creates a more stable signal with less attenuation, as shown in FIG. 8, with a more consistent reading for resonant frequency. In this example, the data was obtained using a typical two-component xerographic developer comprised of toner and carrier in a commercially available development station. This results in the uncertainty of the measured resonant frequency with the lip, $\delta\omega_8$ being substantially less than the uncertainty in the absence of the lip, $\delta\omega_9$. Typically, $\delta\omega_8$'$0.1\delta\omega_9$.

The invention has been described in detail with particular reference to preferred embodiments thereof, but it will be understood that variations and modifications can be effected within the spirit and scope of the invention as set forth in the claims.

What is claimed is:

1. A toner mass sensor comprising:

a piezoelectric crystal having a resonant frequency;

a first electrode on a first face of the crystal;

a second electrode on a second face of the crystal;

an electrically conductive lead connecting the first electrode to an electrical contact point in the vicinity of the second face of the crystal, said electrical contact point being electrically insulated from the second electrode; and a casing closed at one end by the crystal with the first face of the crystal allowed to contact developer outside of the closed casing through the opening of the casing, said casing and crystal defining an interior which is sealed from developer in a development station, within which sealed interior the second face of the crystal is protected from contamination by developer.

2. A toner mass sensor as set forth in claim 1 wherein said electrode is a metal.

3. A toner mass sensor as set forth in claim 3 wherein said metal is aluminum.

4. A toner mass sensor as set forth in claim 1 wherein said casing is cylindrical.

5. A toner mass sensor as set forth in claim 1 further comprising a lip at the open end of the casing against which the crystal is secured.

6. A toner mass sensor as set forth in claim 5 wherein said crystal is secured against the lip by a cylindrical tube which contacts the crystal around the second face.

7. A toner mass sensor as set forth in claim 6 wherein said lip forms an annular surface raised from the first face of the crystal to smooth out the flow of developer as it moves past the crystal.

8. A toner mass sensor as set forth in claim 7 wherein said raised lip has a thickness that varies to form a concave surface.

9. A toner mass sensor as set forth in claim 7 wherein said raised lip smooths out the flow of developer by acting as a barrier to waves of developer which might tend to form around the crystal.

10. A toner mass sensor as set forth in claim 7 wherein said raised lip smooths out the flow of developer by performing a skiving action to reduce any turbulent flow which could result when there is a build-up of toner.

11. A toner mass sensor as set forth in claim 7 wherein said raised lip is approximately 0.25 mm above the first face of the crystal.

12. A toner mass sensor as set forth in claim 1 further comprising:

a source of AC electrical excitation having an electrical frequency corresponding to the resonant frequency of the crystal; and means for selectively applying the AC electrical excitation across the crystal.

13. A toner mass sensor as set forth in claim 12 further comprising means, operable at a predetermined time, for applying a DC bias to the electrode to attract toner particles to the crystal.

14. A toner mass sensor as set forth in claim 13 further comprising means for removing the deposited toner from the crystal electrode by reversing the DC voltage on the electrode.

15. A toner mass sensor as set forth in claim 1 further comprising means for determining the development rate of deposition of toner particle to the crystal.

16. A toner mass sensor comprising:

a piezoelectric crystal having a resonant frequency;

an electrode on a first face of the crystal;

an electrically conductive lead connecting the first face of the crystal to an electrical contact point in the vicinity of a second face of the crystal; and a casing closed at one end by the crystal with the first face of the crystal allowed to contact developer outside of the closed casing through the opening of the casing, said casing and crystal defining an interior which is sealed from developer in a development station, within which sealed interior the second face of the crystal is protected from contamination by developer.

17. A toner mass sensor comprising:

a piezoelectric crystal having a resonant frequency;

an electrode on a first face of the crystal;

an electrically conductive lead connecting the first face of the crystal to an electrical contact point in the vicinity of a second face of the crystal; and a casing closed at one end by the crystal with the first face of the crystal allowed to contact developer outside of the closed casing through the opening of the casing, said casing and crystal defining an interior which is sealed from developer in a development station, within which sealed interior the second face of the crystal is protected from contamination by developer wherein the interior of said casing is closed by a base member which carries an electrical circuit in the base.

18. A toner mass sensor comprising:

a piezoelectric crystal having a resonant frequency;

an electrode on a first face of the crystal;

an electrically conductive lead connecting the first face of the crystal to an electrical contact point in the vicinity of a second face of the crystal; and a casing closed at one end by the crystal with the first face of the crystal allowed to contact developer outside of the closed casing through the opening of the casing, said casing and crystal defining an interior which is sealed from developer in a development station, within which sealed interior the second face of the crystal is protected from contamination by developer further comprising a gasket around the crystal to seal the interior of the casing to inhibit contamination of the interior of the casing by developer.

19. A toner mass sensor as set forth in claim 18 wherein said gasket is formed of elastomeric material.

20. A toner mass sensor as set forth in claim 18 wherein said gasket is an electrical insulator.

21. A toner mass sensor comprising:

a piezoelectric crystal having a resonant frequency;

an electrode on a first face of the crystal;

an electrically conductive lead connecting the first face of the crystal to an electrical contact point in the vicinity of a second face of the crystal;

a casing closed at one end by the crystal with the first face of the crystal allowed to contact developer outside of the closed casing through the opening of the casing, said casing and crystal defining an interior which is sealed from developer in a development station, within which sealed interior the second face of the crystal is protected from contamination by developer;

a lip at the open end of the casing against which the crystal is secured; and a gasket between the lip and the crystal such that the crystal is secured against the lip via the gasket.

22. A toner mass sensor comprising:

a piezoelectric crystal having a resonant frequency;

an electrode on a first face of the crystal;

an electrically conductive lead connecting the first face of the crystal to an electrical contact point in the vicinity of a second face of the crystal;

a casing closed at one end by the crystal with the first face of the crystal allowed to contact developer outside of the closed casing through the opening of the casing, said casing and crystal defining an interior which is sealed from developer in a development station, within which sealed interior the second face of the crystal is protected from contamination by developer;

a source of AC Electrical excitation having an electrical frequency corresponding to the resonant frequency of the crystal; and means for selectively applying the AC electrical excitation across the crystal, wherein the means for applying the AC electrical excitation across the crystal includes an elastometric conductor.

* * * * *